US005309614A

United States Patent [19]

MacKirdy

[11] Patent Number: 5,309,614

[45] Date of Patent: May 10, 1994

[54] SWING BAR HARDWARE FOR CASKETS

[75] Inventor: William T. MacKirdy, Scott Run, Pa.

[73] Assignee: Casket Shells, Inc., Enyon, Pa.

[21] Appl. No.: 895,777

[22] Filed: Jun. 9, 1992

[51] Int. Cl.[5] ..... A61G 17/00

[52] U.S. Cl. ..... 27/10; 16/112; 27/1

[58] Field of Search ..... 27/2, 10; 16/112, 114

[56] References Cited

U.S. PATENT DOCUMENTS

| | | | |
|---|---|---|---|
| 1,779,488 | 10/1930 | Patterson | 27/2 |
| 2,023,211 | 12/1935 | Scholl et al. | 16/112 |
| 3,204,286 | 9/1965 | Hillenbrand | 16/112 |
| 4,615,085 | 10/1986 | Hartman | 16/112 |
| 5,144,727 | 9/1992 | Craft | 27/2 |

*Primary Examiner*—Carl D. Friedman

*Assistant Examiner*—Kien Nguyen

*Attorney, Agent, or Firm*—Kane, Dalsimer, Sullivan, Kurucz, Levy, Eisele & Richard

[57] ABSTRACT

Swing bar hardware for caskets comprises an arm having a top and bottom for receiving a bar at its bottom. A clevis pivotally connected to the arm at its top with a bolt extending laterally from the clevis. A decorative lug having an opening which receives, an insert which engages surrounding surfaces of the lug opening. The base of the insert is adopted to connect with a side wall of a casket; and the clevis engages surfaces of the insert. When the bolt is tightened to the side wall of the casket, the lug will be held on to the side wall and the insert will be connected to the side wall. The lug is non-load bearing and the arm, clevis, insert and bolt is load bearing when the casket is lifted by the bar.

4 Claims, 3 Drawing Sheets

SWING BAR HARDWARE FOR CASKETS

BACKGROUND OF THE INVENTION

The bars or handles on a burial casket in addition to serving a decorative purpose, are utilized during a burial service by pall bearers to lift the casket and transport it to the desired location either during the pre-burial service or to the place of burial. In this regard, the casket, with the body of the deceased, may weigh several hundred pounds, so that the bars may prove necessary to assist the pall bearers in moving the casket. These bars normally are held by a series of arms or brackets connected to the sidewalls of the casket. Burial casket bars of this type are generally a straight tubular member which extends from near one end to near the other end of each side of the burial casket. The arms which constitute the hardware for the bar could either be stationery or swing bar hardware. Typical prior art swing bar hardware is disclosed in U.S. Pat. Nos. 3,204,286 and 4,615,085.

The disadvantage with swing bar hardware systems currently being utilized as is typified in the above decorative lugs for each style of hardware which support and bear the load of the casket when lifted by the swing bar. This prior art requires expensive molds for each style lug which may be machine cast, slush cast or die cast eventually resulting in a lug which is expensive itself. In this regard heavy zinc members are generally used for swing bar hardware.

Another current system that possesses similar drawbacks is a steel stamped arm that is formed to shape with two tabs on each side. These tabs are inserted into slots and a semi-circular cut out in the lug. The tabs are clinched over the small bar between the slots and the semi-circular cut out. The hardware is attached to the casket with sheet metal screws.

SUMMARY OF THE INVENTION

The principle object of the present invention is to eliminate the foregoing disadvantages of the prior art by and permit inexpensive decorative lugs that don't receive any load when lifting the casket by the swing bar while making provisions for adequate connection and support for the bar to the casket.

Another principal object is to permit the continued use of existing bolt on clevis/arm system.

A further object is to eliminate the need for expensive dies while permitting a wide variety of aesthetically pleasing lugs at less cost.

Still another object is to reduce to half the number of screws and bolts that must be applied for swing bar hardware, thereby reducing labor costs.

BRIEF DESCRIPTION OF THE DRAWINGS

The objects and advantage of the present invention will become apparent from the following detailed description which is to be taken in connection with the accompanying drawings in which like numerals designate like parts, and in which.

DETAILED DESCRIPTION OF THE PREFERRED EMBODIMENTS OF THE INVENTION

Figure 1:
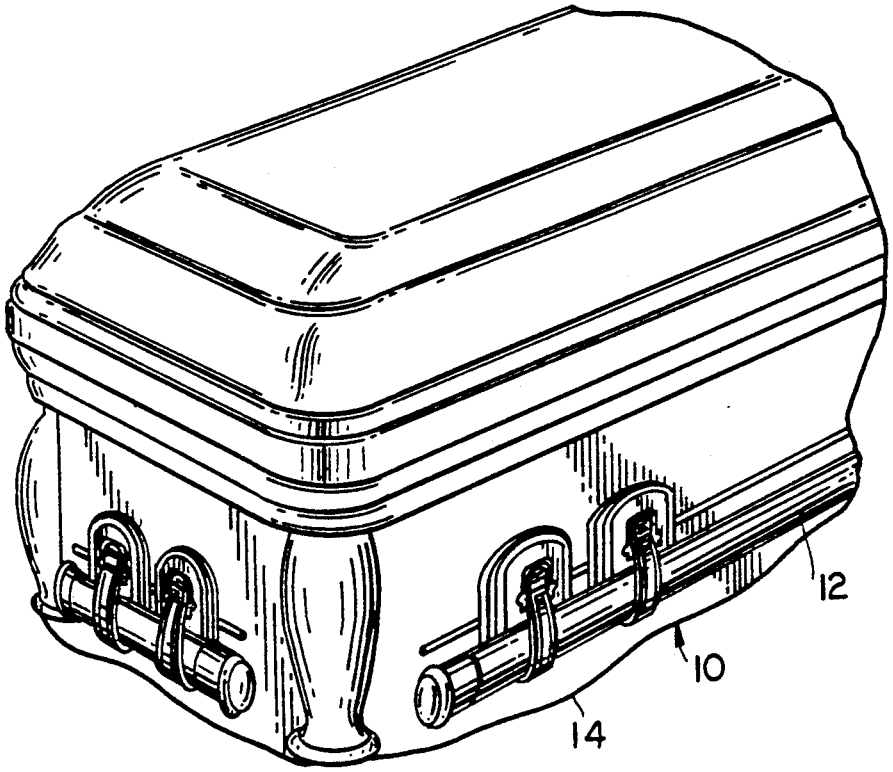
FIG. 1 is a perspective view of burial casket utilizing the swing bar hardware system of the present invention.
Figure 2:
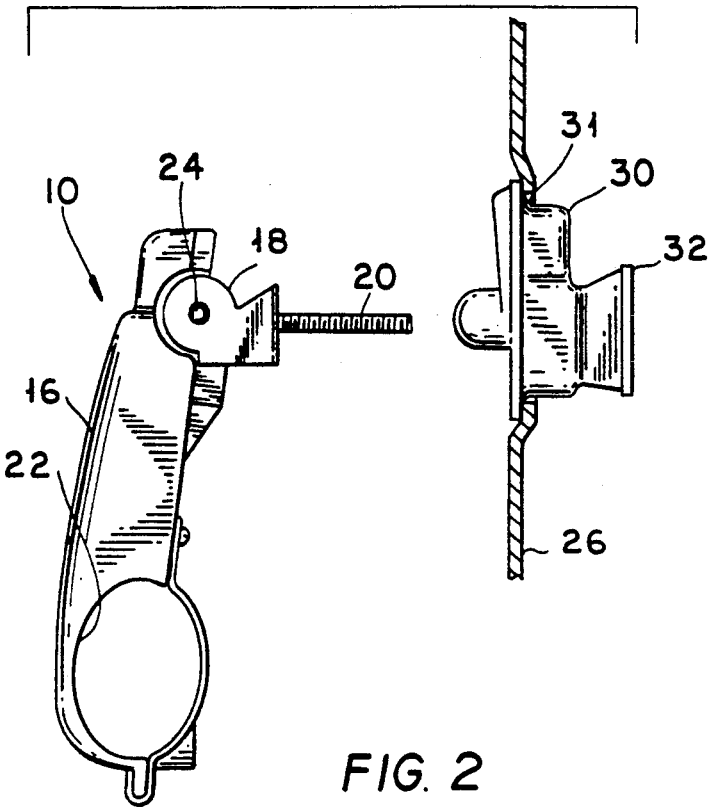
FIG. 2 is an exploded side view of the swing bar hardware of the present invention showing the arm with clevis and bolts and an insert in a decorative lug shown fragmentarily in section.
Figure 3:
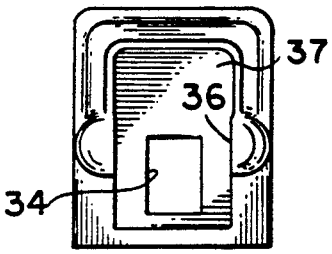
FIG. 3 is a front elevational view of the insert.
Figure 4:
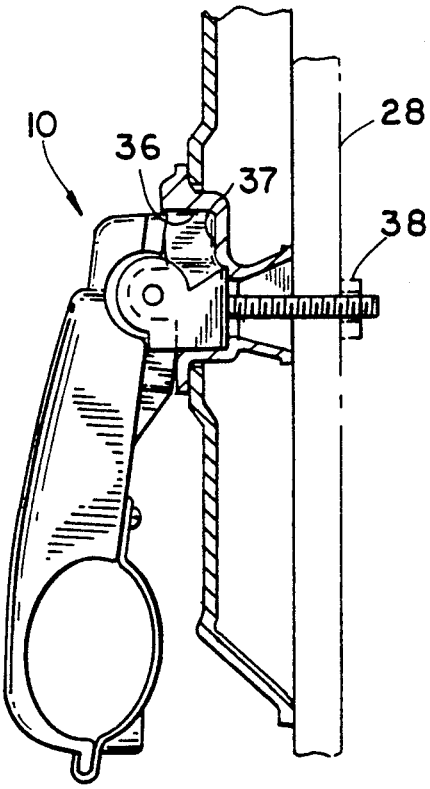
FIG. 4 is similar to FIG. 2 with the swing bar hardware assembled on the side of the casket shown in phantom.
Figure 5:
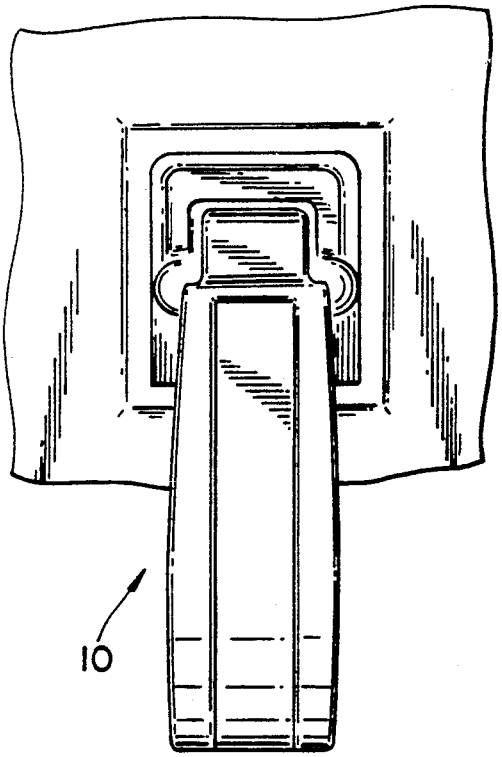
FIG. 5 is a front elevational view of the assembly of FIG. 4.

In the drawings the swing bar hardware 10 of the present invention for a bar 12 on a casket 14 will be permitted to utilize an existing arm 16, clevis 18 and bolt 20. The arm 16 is provided with opening 22 for receiving bar 12 and is pivotal on clevis 18 at connection 24.

Instead of direct connection to lug 26 and then connection to the casket side wall 28 as in the prior art so that the lug itself will be load bearing when the casket 14 is lifted by the bar 12, an insert 30 is employed instead which extends through opening 31 on the lug 26 and holds it in place on the casket side wall 28. Insert 30 is provided with a base 32 for resting on the casket side wall 28. The base is provided with opening 34 for receiving the bolt 20. A recess 36 in the insert 30 has clevis bearing surfaces 37 and receives the distal end of the clevis 18 and anchors it with respect to the insert 30 and consequently casket wall 28 when the bolt 20 is tightened by means of the nut 38. Inasmuch as the lug 26 is not load bearing, it may be decorated plastic, vacuum formed metalized plastic or plastic with a metallic finish or it may be inexpensive and then material that is painted or metallic plated.

Figure 6:
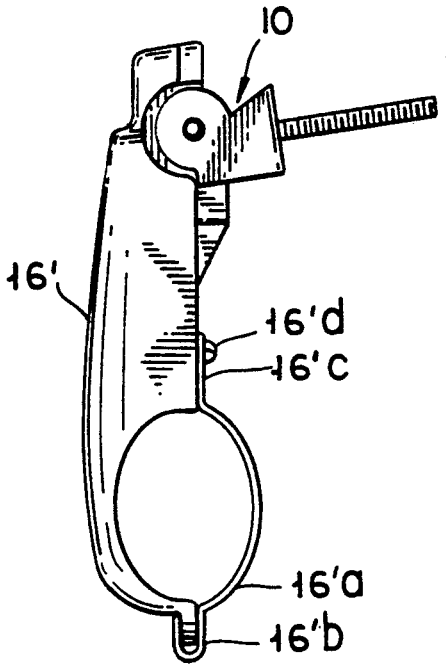
FIGS. 6–8 show an alternative embodiment of arm usable with the present invention.
Figure 7:
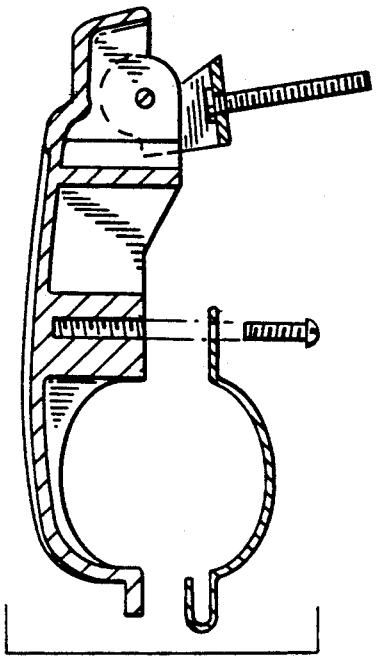
Figure 8:
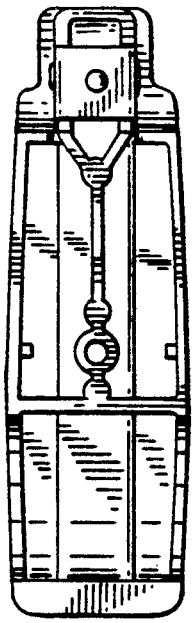

In FIGS. 6–8, bar 12 is supported by arm 16' which receives clip 16'A clipped to the arm 16' at one end 16'B and recessed at its other end by 16'C by bolt 16'D. In all other respects, arm 16' performs the same function as arm 16 of the previous embodiment. The advantage of this embodiment is that the swing bar and hardware may be assembled before placement on the casket. This saves labor and reduces scratching of the bar hardware and casket.

Thus, the several aforenoted objects and advantages are most effectively attained. Although several somewhat preferred embodiment of the invention has been disclosed and described in detail herein, it should be understood that this invention is in no sense limited thereby and its scope is to be determined by that of the appended claims.

What is claimed is:

1. Swing bar hardware for caskets comprising an arm having a top and bottom for receiving a bar at its bottom, a clevis, means for pivotally connecting the clevis to the arm at its top, a bolt extending laterally from the clevis, a decorative lug having an opening, an insert extending into the opening of the lug and engaging surrounding surfaces of the lug and having a base adapted to connect with a side wall of the casket in a load bearing capacity, the insert including an opening aligned with the opening in the lug and through which the bolt extends, clevis bearing surfaces surrounding the opening in the insert, the clevis engaging the clevis bearing surfaces of the insert and being fixed thereto, the insert having a recess in which the clevis bearing surfaces of the clevis are disposed, whereby when the bolt is tightened to the side wall of the casket, the lug will be held onto the side wall and the insert is connected to the side wall and the clevis is connected to the insert, the lug is non-load bearing and the arm, clevis, insert and bolt are load bearing when the casket is lifted by the bar.

2. The invention according to claim 1 wherein the arm is provided with an opening for receiving the bar and a separate clip is provided for extending over the bar opening and enclosing the bar to the arm, and means for connecting the clip to the arm.

3. A casket having a swing bar and at least two swing bar hardware assemblies connecting the bar to a side wall of a casket, each swing bar hardware assembly comprising an arm having a top and bottom for receiving a bar at its bottom, a clevis, means for pivotally connecting the clevis to the arm at its top, a bolt extending laterally from the clevis, a decorative lug having an opening, an insert extending into the opening of the lug and engaging surrounding surfaces of the lug and having a base adapted to connect with a side wall of the casket in a load bearing capacity, the insert including an opening aligned with the opening in the lug and through which the bolt extends, clevis bearing surfaces surrounding the opening in the insert, the clevis engaging the clevis bearing surfaces of the insert and being fixed thereto, the insert having a recess in which the clevis bearing surfaces of the clevis are disposed, whereby when the bolt is tightened to the side wall of the casket, the lug will be held onto the side wall and the insert is connected to the side wall and the clevis is connected to the insert, the lug is non-load bearing and the arm, clevis, insert and bolt are load bearing when the casket is lifted by the bar.

4. The invention according to claim 3 wherein the arm is provided with an opening for receiving the bar and separate clip is provided for extending over the bar opening and enclosing the bar to the arm, and means for connecting the clip to the arm.

* * * * *